United States Patent [19]

Mitchell et al.

[11] Patent Number: 4,680,814

[45] Date of Patent: Jul. 21, 1987

[54] SHOULDER PAD SPRING ARCH SYSTEM

[75] Inventors: Hal D. Mitchell; Donald R. Walker, both of Rolla, Mo.

[73] Assignee: Figgie International Inc., Willoughby, Ohio

[21] Appl. No.: 901,727

[22] Filed: Aug. 29, 1986

[51] Int. Cl.[4] ..... A41D 13/00

[52] U.S. Cl. ..... 2/2; 2/45

[58] Field of Search ..... 2/2, 45

[56] References Cited

U.S. PATENT DOCUMENTS

| | | | |
|---|---|---|---|
| 2,071,827 | 2/1937 | Glahe | 2/2 |
| 2,163,463 | 6/1939 | Kennedy | 2/2 |
| 2,545,039 | 3/1951 | Mitchel | 2/2 |
| 2,953,789 | 9/1960 | Morgan et al. | 2/2 |
| 3,017,639 | 1/1962 | Foley | 2/2 |
| 3,127,614 | 4/1964 | Bennett | 2/2 |
| 4,547,905 | 10/1985 | LaPorta | 2/2 |

*Primary Examiner*—Louis K. Rimrodt

*Attorney, Agent, or Firm*—Senniger, Powers, Leavitt and Roedel

[57] ABSTRACT

A spring arch system for a shoulder pad, such as a football shoulder pad. The spring arch system comprises inner and outer arches of generally inverted U-shape as viewed from the side. The outer arch extends substantially over the inner arch from a forward portion of the inner arch to a rearward portion of the inner arch. The spacing between the arches is such that the arches form a generally wedge-shaped configuration at least in the area of the top of the inverted U-shape. Impact on the outer arch causes deformation thereof relative to the inner arch, and thus some of the energy of the impact is absorbed through such relative deformation.

14 Claims, 3 Drawing Figures

SHOULDER PAD SPRING ARCH SYSTEM

BACKGROUND OF THE INVENTION

The invention relates generally to shoulder pads for football players and the like, and more particularly to a spring arch system for such a shoulder pad.

Shoulder pads are generally designed to reduce and spread impact loads from colliding football players over the shoulders of the wearer. Heretofore, shoulder pad designs have included a hard outer layer, thick inner padding sections and various combinations of epaulets and web hinges. While the inner padding sections have served to absorb the impact load, the hard outer layer has served merely to spread the load over a somewhat larger area of the padding sections than would otherwise be the case. A shoulder pad having an energy absorbing outer layer in addition to the energy absorbing padding sections would be advantageous for further reducing the impact load transmitted to the shoulders of a wearer. In particular, a hard outer layer that serves both to spread and to absorb the impact load would be desirable since it would entail minimal additional weight or size for the shoulder pad.

SUMMARY OF THE INVENTION

Among the several objects of this invention may be noted the provision of a shoulder pad spring arch system, particularly adapted to reduce the impact load transmitted to the shoulders of a player, that is lightweight and which does not unduly increase the size of the shoulder pad; the provision of such a spring arch system that is inexpensive and durable; and the provision of such a spring arch system which actually absorbs impact energy through deformation.

Generally, a spring arch system of the present invention is designed for a shoulder pad, such as a football shoulder pad, and has an inner arch and an outer arch. The inner and outer arches are of generally inverted U-shape as viewed from the side. The outer arch extends substantially over the inner arch from a forward portion of the inner arch to a rearward portion of the inner arch. The spacing between the arches is such that the arches form a generally wedge-shaped configuration at least in the area of the top of the inverted U-shape. Impact on the outer arch causes deformation thereof relative to the inner arch, and thus some of the energy of the impact is absorbed through such relative deformation.

In a second aspect of this invention, a shoulder pad is adapted for football players and the like. The shoulder pad comprises a left-hand member adapted to fit over the left shoulder and a right-hand member adapted to fit over the right shoulder. The members are of generally inverted U-shape as viewed from the side, and are laterally spaced to provide an opening for the neck of a wearer with the spacing such that the members lie adjacent and relatively close to the neck. Each member has an inner arch and an outer arch. The outer arch extends substantially over the inner arch from a forward portion of the inner arch to a rearward portion of the inner arch. The arches are spaced apart such that they form a generally wedge-shaped configuration at least in the area of the top of the inverted U-shape. Impact on the outer arch causes deformation thereof relative to the inner arch, and thus some of the energy of the impact is absorbed through relative deformation.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
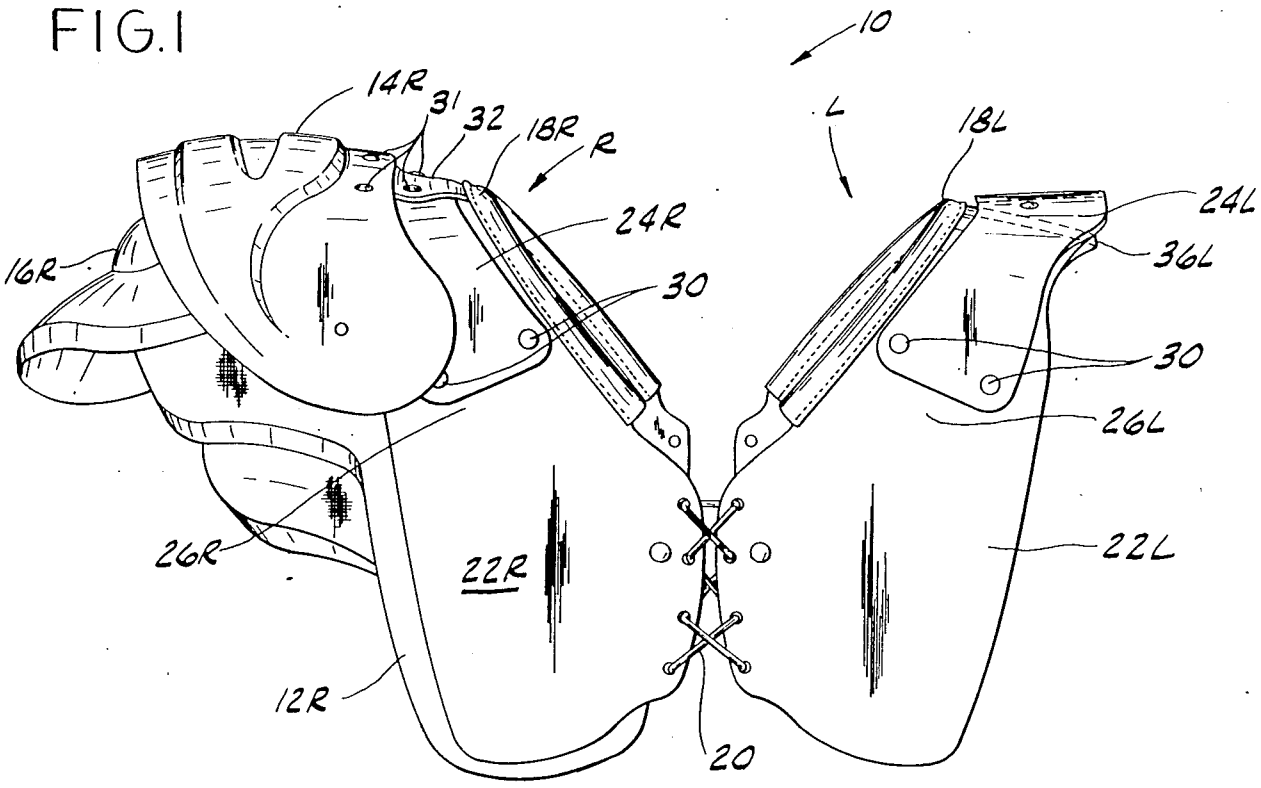
FIG. 1 is a front elevation of a shoulder pad, with some parts removed from the left-hand member for clarity, showing a spring arch system of the present invention.

Now referring to the drawings, a shoulder pad of the present invention is designated in its entirety by the reference numeral 10. As shown in FIG. 1, the shoulder pad comprises a left-hand member generally designated L and a right-hand member generally designated R. Left-hand member L is adapted to fit over the left shoulder of a football player, etc., and right-hand member R is adapted to fit over the right shoulder. For example, left-hand member L and right-hand member R have inner padding sections, such as inner padding member 12R shown in FIG. 1, which along with the right-hand and left-hand members have a generally inverted U-shape as viewed from the side (see FIG. 3). The shoulder pad may be provided with conventional upper epaulets (e.g., upper epaulet 14R) and outer epaulets (e.g., outer epaulet 16R). Conventional side straps (not shown) may also be provided for securing the shoulder pad to the shoulders of the football player.

As shown in FIG. 1, left-hand member L and right-hand member R are laterally spaced to provide an opening for the neck of a wearer with the spacing such that the inner edges 18L and 18R, respectively, of the arches lie adjacent and relatively close to the neck. For example, conventional laces 20 may be provided for adjustably interconnecting the members R and L, or rivets (not shown) may fixedly interconnect the left-hand member L to the right-hand member R, preferably at the back sides thereof, thereby maintaining such lateral spacing between the members.

Left-hand member L is hereinafter used to illustrate various aspects of the invention. It is understood, though, that the following discussion applies to both the right-hand and left-hand members, with the right-hand member being a mirror image of the left-hand member.

Figure 2:
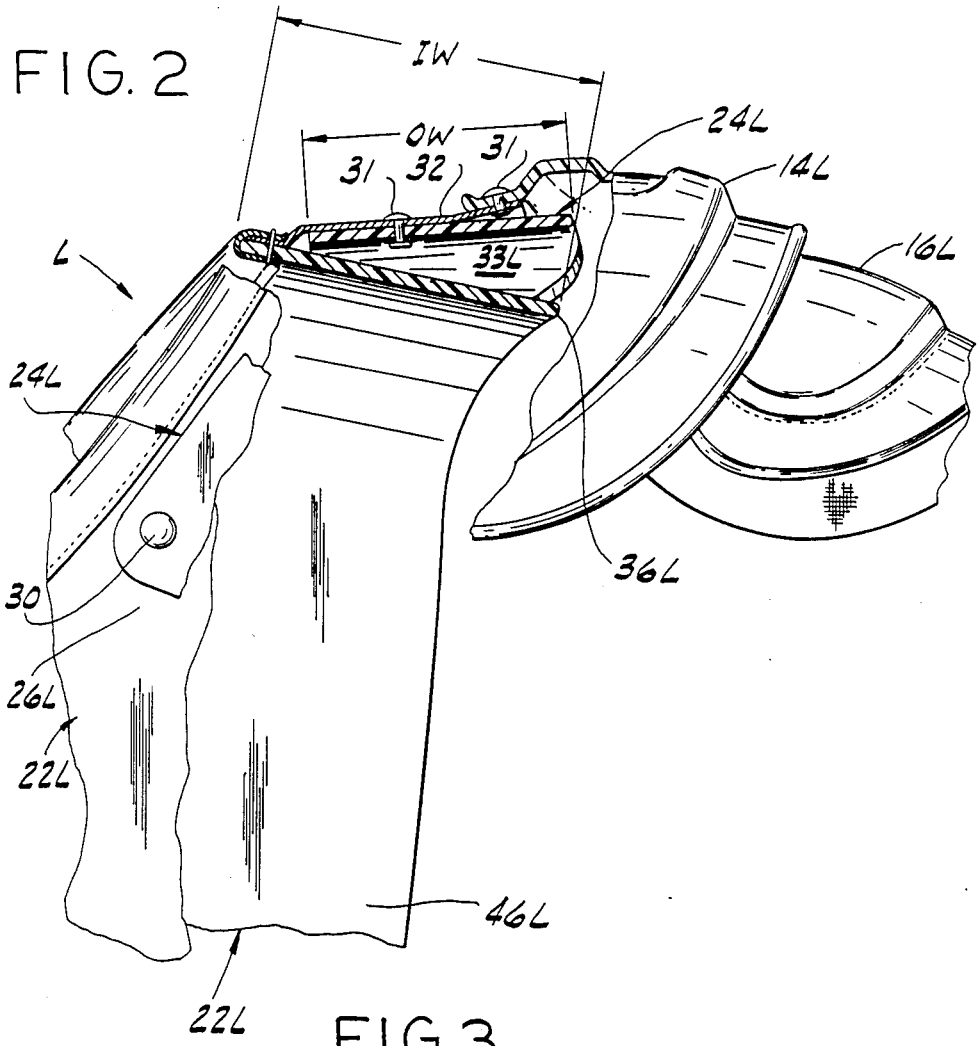
FIG. 2 is a front elevation of a left-hand member of the shoulder pad of FIG. 1, broken away to show the spring arch system.
Figure 3:
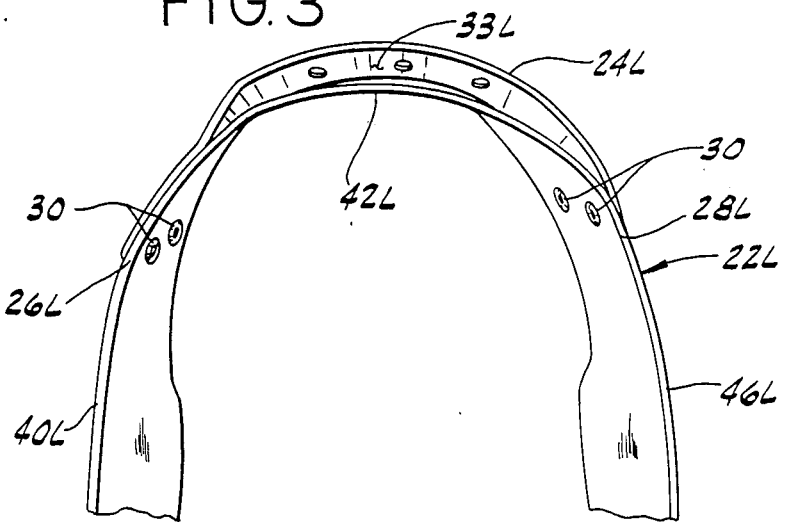
FIG. 3 is a side elevation of the shoulder pad of FIG. 1.

As shown in FIG. 3, the left-hand member has inner and outer arches 22L and 24L, respectively, of relatively stiff and non-brittle plastic material. The outer arch extends substantially over inner arch 22L from a forward portion 26L of the inner arch to a rearward portion 28L of the inner arch. The width OW of outer arch 24L is preferably slightly less than the width IW of inner arch 22L, as shown in FIG. 2. While it is contemplated that arches 22L and 24L may be of integral construction, they are shown and hereinafter described as being separate members. Means (e.g., rivets 30) are then provided for attaching and securing outer arch 24L to inner arch 22L at the forward and rearward portions 26L and 28L of the inner arch. In addition, means may be provided to the outer arch for attaching outer epaulet 14L, such as, for example, rivets 31 and web hinge 32 shown in FIG. 2.

The arches 22L, 24L are spaced apart such that they form a generally wedge-shaped configuration at least in the area of the top 33L of the inverted U-shape. For example, the wedge shape may slope from the inner edge 18L adjacent the neck of the wearer to an outer lateral edge 36L opposite the inner edge. One advantageous result of this construction is that impact (from colliding football players, for example) on outer arch 24L causes deformation thereof relative to inner arch 22L, and thus some of the energy of the impact is absorbed through relative deformation instead of being transmitted to the shoulder of a wearer. The wedge-shape construction where the wedge slopes from the neck of the wearer, in particular, is believed to be advantageous since most blows are taken at the outside lateral edge 36L of the shoulder pad. It will be understood, therefore, that inner arch 22L and outer arch 24L constitute one embodiment of the spring arch system.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A spring arch system for a shoulder pad, such as a football shoulder pad, the spring arch system having an inner arch and an outer arch, the inner and outer arches being of generally inverted U-shape as viewed from the side, and the outer arch extending substantially over the inner arch from a forward portion of the inner arch to a rearward portion of the inner arch with the spacing such that the arches form a generally wedge-shaped configuration at least in the area of the top of the inverted U-shape such that impact on the outer arch causes deformation thereof relative to the inner arch so as to absorb some of the energy of the impact through such relative deformation.

2. A spring arch system as set forth in claim 1 wherein the wedge shape slopes from an inner edge of each member adapted to be adjacent the neck to an outer edge opposite the inner edge.

3. A spring arch system as set forth in claim 1 wherein the inner and outer arches are separate members, the shoulder pad spring arch system including means for attaching the outer arch to the inner arch.

4. A spring arch system as set forth in claim 3 wherein the attachment means includes securing the outer arch to the inner arch at the forward and rearward portions of the inner arch.

5. A spring arch system as set forth in claim 1 wherein the inner and outer arches are of a plastic material, the plastic material being relatively stiff and non-brittle.

6. A spring arch system as set forth in claim 1 includes an epaulet, a web hinge for the epaulet and means for attaching the web hinge to the outer arch.

7. A spring arch system as set forth in claim 1 wherein the outer arch has a width slightly smaller than the width of the inner arch.

8. A shoulder pad for football players and the like comprising a left-hand member adapted to fit over the left shoulder and a right-hand member adapted to fit over the right shoulder, each of the members being of generally inverted U-shape as viewed from the side, the members being laterally spaced to provide an opening for the neck of a wearer with the spacing such that the members lie adjacent and relatively close to the neck, each member having an inner arch and an outer arch, the outer arch extending substantially over the inner arch from a forward portion of the inner arch to a rearward portion of the inner arch with the spacing such that the arches form a generally wedge-shaped configuration at least in the area of the top of the inverted U-shape such that impact on the outer arch causes deformation thereof relative to the inner arch so as to absorb some of the energy of the impact through such relative deformation.

9. A shoulder pad as set forth in claim 8 wherein the wedge shape slopes from an inner edge of each member adapted to be adjacent the neck to an outer edge opposite the inner edge.

10. A shoulder pad as set forth in claim 8 wherein the inner and outer arches are separate members, the shoulder pad spring arch system including means for attaching the outer arch to the inner arch.

11. A shoulder pad as set forth in claim 10 wherein the attachment means includes securing the outer arch to the inner arch at the forward and rearward portions of the inner arch.

12. A shoulder pad as set forth in claim 8 wherein the inner and outer arches are of a plastic material, the plastic material being relatively stiff and non-brittle.

13. A shoulder pad as set forth in claim 8 includes an epaulet, a web hinge for the epaulet and means for attaching the web hinge to the outer arch.

14. A shoulder pad as set forth in claim 8 wherein the outer arch has a width slightly smaller than the width of the inner arch.

* * * * *